United States Patent [19]

Polhuis

[11] 4,105,208

[45] Aug. 8, 1978

[54] INDOOR FOOTBALL (SOCCER) MATCH SET

[76] Inventor: Antonius Polhuis, Oldenkotterstrasse 56, 4426 Vreden, Germany

[21] Appl. No.: 768,774

[22] Filed: Feb. 15, 1977

[30] Foreign Application Priority Data

Feb. 19, 1976 [DE] Fed. Rep. of Germany ..... 2606607

[51] Int. Cl.[2] ..... A63F 63/04; A63F 71/04; A63F 71/06

[52] U.S. Cl. ..... 273/95 R; 273/55 R; 273/65 EE; 273/102.1 D; 273/102.4; 273/127 D; 273/DIG. 8; 273/DIG. 26

[58] Field of Search ..... 273/95 R, 95 H, 1 R, 273/1 B, 55 R, 56, 102 R, 102 S, 102 B, 102.1 R, 102.1 C, 102.1 D, 102.1 E, 102.4, 127 R, 127 B, 127 C, 127 D, DIG. 26, DIG. 8, DIG. 20, 118 R, 85 R, 101, 65 EE

[56] References Cited

U.S. PATENT DOCUMENTS

| | | | |
|---|---|---|---|
| 2,992,003 | 7/1961 | Smolen et al. | 273/102.1 R |
| 3,785,552 | 1/1974 | Payne, Jr. | 273/85 R X |
| 3,834,701 | 9/1974 | Hashimoto | 273/101 X |
| 3,865,375 | 2/1975 | Cosgrove | 273/127 R X |

*Primary Examiner*—William H. Grieb
*Attorney, Agent, or Firm*—Cushman, Darby & Cushman

[57] ABSTRACT

An indoor football (soccer) match set including at least one gate or goal, but preferably two goals, and a ball. A movable plate within the goal is responsive to a ball entering the goal. A movement of the plate is transmitted to a counter mechanism through a latch element having a cam which contacts the rear face of the plate. The counter mechanism comprises a bar having numbered marker panels arranged thereon, which bar is adapted to move downwards by one panel each with every movement of the plate. The downward movement of the bar is controlled by latches of the latch element which engage teeth in the bar.

6 Claims, 5 Drawing Figures

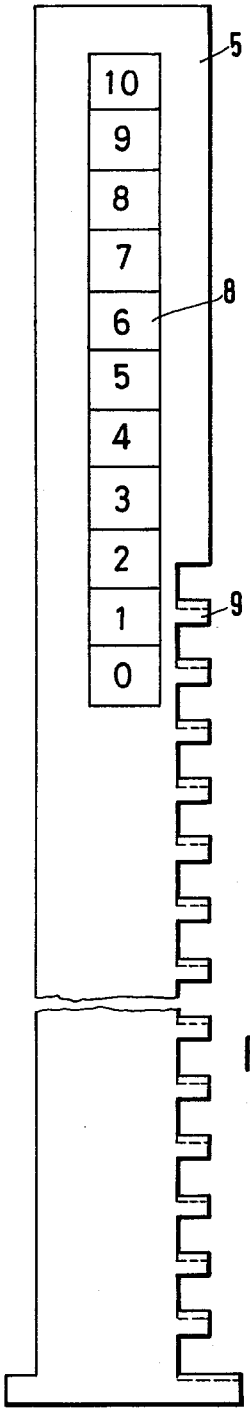
Fig.5
Fig.3
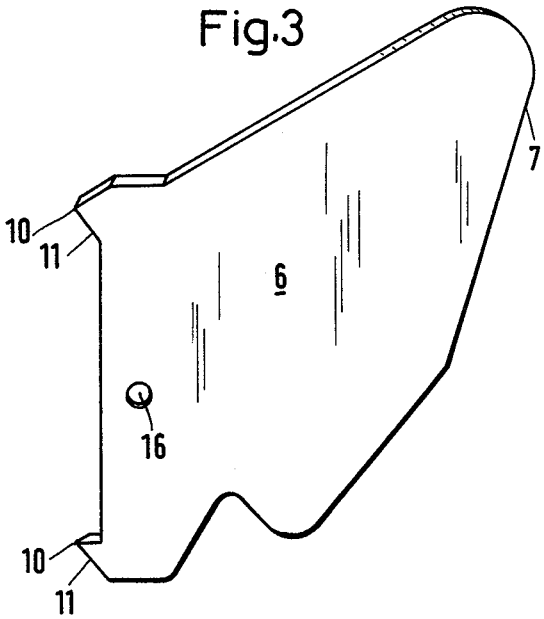
Fig.4
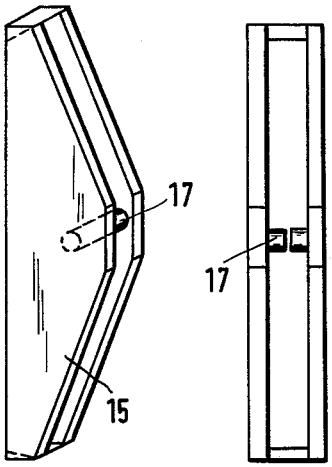

INDOOR FOOTBALL (SOCCER) MATCH SET

The present invention relates to an indoor football (soccer) match set including one or more gates or goals, preferably two goals, and a ball.

Table football sets are known wherein a ball must be kicked into one of a pair of oppositely arranged goals by manipulating player figures. However, it is of disadvantage in these conventional sets that these structures, in contrast with a real football match, do not provide for sporting movement of the player, that the ball cannot be kicked by foot in the natural way, and that an exact indication or display of goals achieved cannot be provided such that dispute may arise with respect to the number of goals achieved.

Furthermore, it is known to play football or soccer within halls by using goals of reduced size. However, it is of disadvantage hereby that a hall (covered court) must be available. This prerequisite does not exist in normal households, such that the actual playing is impossible.

Accordingly, it is the object of the present invention to provide an indoor football (soccer) match set which may be used for playing in rooms and on miniature fields, such as terraces, garden areas and the like and which, nevertheless, necessitates sporting movement to be exercised by the players. Additionally, the set should avoid any possibility of damage to furniture or to the walls of the room, while allowing the match to be executed even in small rooms; also, the set should be attainable to wide circles of consumers. The match should lend itself to be played by two or more partners, a goal achieved should be displayed positively, and even an individual person should be enabled thereby to exercise football training. On the whole, the conditions of the match should resemble as far as possible the conditions of the actual football match on an outdoor field.

According to the present invention, this object is solved in that said goals include within the goal area thereof a movable plate adapted to actuate a counter mechanism and/or a signal by its movement under a slight impact.

In order to avoid damage, the ball is preferably formed of a soft plastic foam material, and in order to allow to positively classify even light impulses as a goal achieved, the plate disposed within the goal area is formed of a hard plastic foam material. In this way, the plate is of sufficient strength so as to transmit even contacts with its edges without any significant distortion and thereby to operate the counter mechanism or the signal.

The movable plate may be pivoted about one of its longitudinal edges; in this structure, the pivoting movement may be limited by stoppers disposed in front and at the rear of the plate. In detail, movement of the plate may be transmitted to the counter mechanism through a latch element having a cam which contacts the rear face of the plate, while the counter mechanism may comprise a bar having numbered marker panels arranged one above the other, which bar is adapted to move downwards by one panel each with every movement of the plate (goal achieved).

The bar as such is provided with a plurality of superposed teeth which are engaged by the latches of the latch element, and the latches may be provided at their lower sides with an upwardly and outwardly extending bevel each such that the bar may be drawn upwards before starting a new match.

In this way, it is obtained that the bar may be drawn up prior to starting a new match, whereby the bar is set to the goal count of zero. Each time the plate is touched by the ball, this corresponding to a goal being achieved, the movement of the plate causes the bar to be lowered by one marker panel whereby the respective number or count of goals is displayed.

Below, an exemplary embodiment of the present invention is explained in greater detail by refering to the enclosed drawings, wherein:

FIG. 3 is a perspective view of the latch element;

FIG. 4 is a perspective front elevantional view of the mounting bracket; and

FIG. 5 is a view of the bar constituting the counter mechanism.

Figure 1:
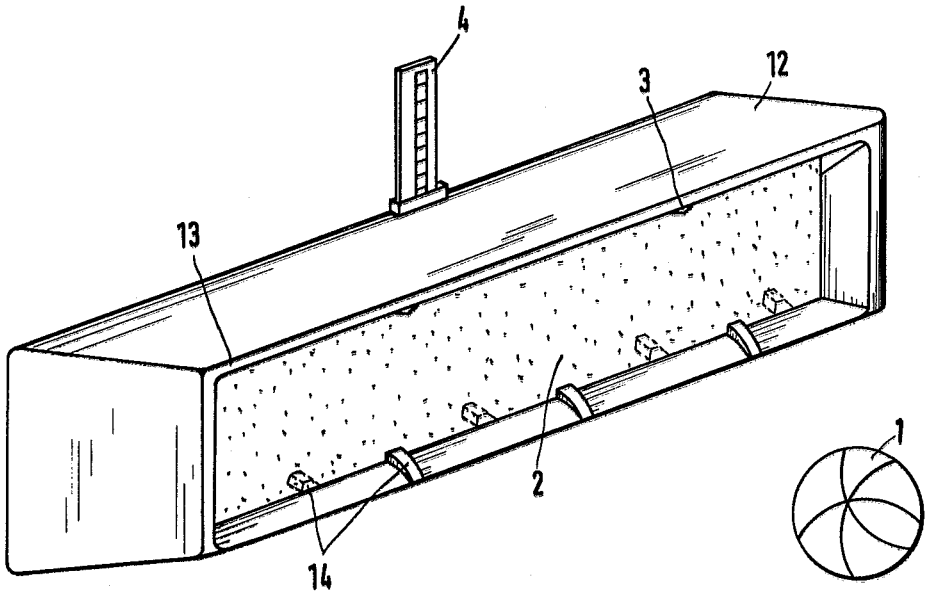
FIG. 1 is a perspective view of a goal or gate with the associated ball.

The indoor football match set comprises a plurality of goals, preferably two goals, and a ball, with the length-/height dimensions of the goals corresponding to reduced-size football gates or goals of the real field. In this embodiment, the height is about 23 cm. The ball is not reduced in the same ratio; its diameter may be e.g. from 10 to 12 cm. The ball 1 is milled from a soft plastic foam material or produced by foaming the material within corresponding molds; for instance, the ball may consist of polyurethane foam material. On the other hand, the weight of the ball is so small that it cannot cause damage to furniture, walls and the like, whereas the ball is of such a size that a kicked ball is capable of causing movement of a plate within the goal area.

The goal comprise a housing 12 having a protruding, peripheral edge 13 into which a movable plate 2 is inserted in rearwardly displaced relation. The plate 2 is formed of a hard foam material; in this way, the plate exhibits sufficient stability to distortion while, on the other hand, the weight of the plate is small enough so that even light impacts exerted by the ball cause the plate to move.

The lower edge of the plate 2 is mounted in the lower portion of the housing by means of a plurality of transversely extending, raised portions 14 integrally formed with the housing and disposed in front and at the rear of the plate 2, so as to be pivotally movable in the inner region of the housing. The upper edge of the plate 2 is positioned between stoppers 3 which are mounted to the upper part of the housing so as to extend downwards, with the stoppers provided in front of the plate being arranged with such a spacing from the rear stoppers that small pivotal movement of the plate about its lower edge may take place (FIG. 2) when a ball hits the plate 2. The rear stoppers 3 are formed of a highly resilient rubber foam. Preferably, the plate 2 is installed into its bracket with a slight downward inclination such that the plate may return into its original position by gravity to indicate a goal achieved.

Movement of plate 2 may result either in the actuation of a counter mechanism 4 or in the generation of a signal. The signal may be of acoustic (bell) or optical (lamp) nature. The respective mode of signal generation is left to the expert and need not be discussed in any greater detail herein.

Figure 2:
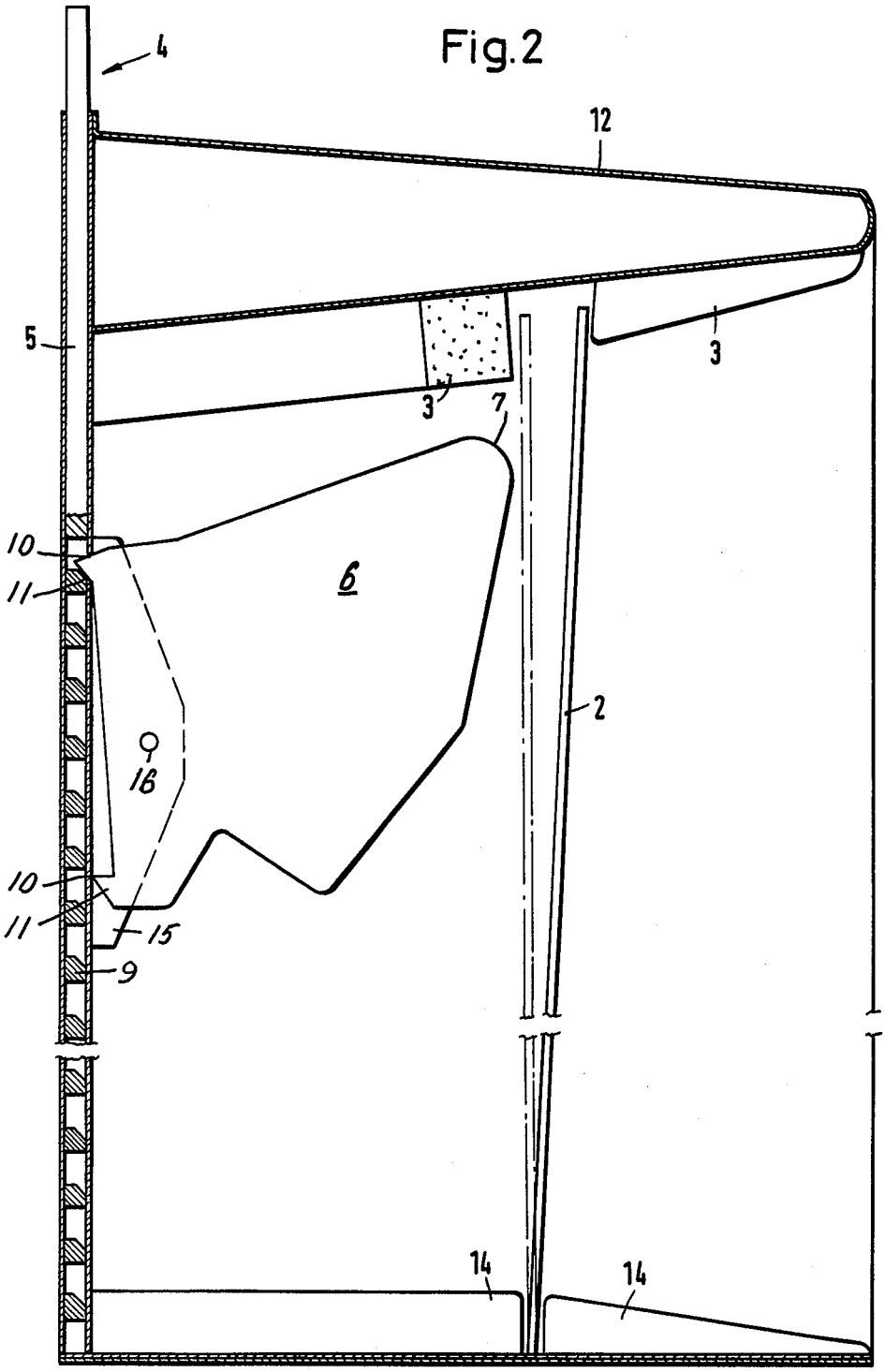
FIG. 2 is a sectional view of the goal, taken in the plane of the goal counting bar.

As shown in FIG. 2, however, plate 2 is coupled to a counter mechanism 4 comprising a vertical rod or bar 5. A latch element 6 is operatively interposed between said bar 5 and plate 2, which element or member has a front cam 7 thereof in contact with the rear face of plate 2 or positioned with a slight spacing from such rear face. Latch element 6 is pivotably mounted through hole 16 to a fixed position on housing 12 by means of mounting bracket 15 (see FIG. 2). As illustrated in FIGS. 4 and 2, pins 17 are positioned so as to engage hole 16.

The latch element 6 carries on its rear face an upper and a lower latch 10 each, which latches engage teeth 9 of bar 5 such that when the latch element 6 is pivoted to thereby disengage one of said latches, the other latch allows the bar to slide down by one tooth only. Pivoting of the latch element takes place when plate 2 is displaced towards the rear side of the housing under the impact of the ball.

The upper end of bar 5 is provided with a plurality of marker panels 8 provided with figures such that the number of goals achieved may be ascertained depending on the position of bar 5. The bevel 11 of the latches 10 at their lower, rearwardly directed edges, and also at the upper edge in the case of the latch, permits the bar 5 to be drawn out at the start of a new match because of a corresponding configuration of teeth 9 which have their upper, front portions bevelled in a similar manner, such that the goal number of zero may be set; the bar may slide down by one tooth each when the latch element 6 is pivoted upon achieving a goal.

What I claim is:

1. An indoor football (soccer) match set comprising:
at least one goal;
a ball of such size as to be able to enter said goal;
a movable plate positioned within said goal;
a bar having numbered marker panels disposed one above the other, said bar having a plurality of teeth arranged one above the other; and
latch element means having latches for engaging said teeth, and having a cam engaging the rear face of said plate, said bar and said latch element means being positioned so that said bar moves downward by one marker panel with every impact of said ball against said plate.

2. The set according to claim 1, wherein said plate is mounted for pivotal movement about one of its longitudinal edges.

3. The set according to claim 2, wherein the pivotal movement is limited by stoppers mounted in front and at the rear of said plate.

4. The set according to claim 1, wherein said latches are provided at their lower sides with an upwardly and outwardly extending bevel each so as to allow said bar to be drawn out in upward direction.

5. The set according to claim 1, wherein said plate is formed of a hard plastic foam material.

6. The set according to claim 1, wherein said ball is formed of a soft plastic foam material.

* * * * *